US011850850B2

(12) United States Patent
Yokoyama

(10) Patent No.: US 11,850,850 B2
(45) Date of Patent: Dec. 26, 2023

(54) DISCHARGE CONTROL APPARATUS, LIQUID DISCHARGE APPARATUS, AND COMPUTER-READABLE MEDIUM

(71) Applicant: Kayo Yokoyama, Tokyo (JP)

(72) Inventor: Kayo Yokoyama, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 16 days.

(21) Appl. No.: 17/399,168

(22) Filed: Aug. 11, 2021

(65) Prior Publication Data

US 2022/0063270 A1 Mar. 3, 2022

(30) Foreign Application Priority Data

Aug. 26, 2020 (JP) ..... 2020-142788

(51) Int. Cl.
*B41J 2/07* (2006.01)
*B41J 2/21* (2006.01)

(52) U.S. Cl.
CPC ..... *B41J 2/07* (2013.01); *B41J 2/2139* (2013.01); *B41J 2/2146* (2013.01)

(58) Field of Classification Search
CPC . B41J 2/07; B41J 2/2139; B41J 2/2146; B41J 29/38; B41J 2/21; B41J 2/2132; B41J 2/2142; B41J 2/0451; B41J 2/165; B41J 29/393; B41J 2/04595; B41J 2/175
See application file for complete search history.

(56) References Cited

U.S. PATENT DOCUMENTS

| | | | | |
|---|---|---|---|---|
| 2011/0020027 | A1 | 1/2011 | Takubo et al. | |
| 2012/0195619 | A1 | 8/2012 | Takubo et al. | |
| 2013/0271786 | A1 | 10/2013 | Yokoyama | |
| 2014/0071191 | A1 | 3/2014 | Ueshima | |
| 2018/0181452 | A1 | 6/2018 | Yamawaki et al. | |
| 2019/0171154 | A1* | 6/2019 | Kobayashi | G03G 15/6558 |
| 2020/0012547 | A1 | 1/2020 | Yamawaki et al. | |
| 2020/0290367 | A1* | 9/2020 | Kawafuji | B41J 29/393 |

FOREIGN PATENT DOCUMENTS

| | | |
|---|---|---|
| JP | 2006-173929 | 6/2006 |
| JP | 2014-054763 | 3/2014 |

* cited by examiner

*Primary Examiner* — Jannelle M Lebron
(74) *Attorney, Agent, or Firm* — Harness, Dickey & Pierce, P.L.C.

(57) ABSTRACT

A discharge control apparatus includes a storage control unit, and a correction value update unit. The storage control unit is configured to store, in a storage unit, a correction value for correcting a value related to discharge performed by a liquid discharge unit configured to discharge liquid to a discharge target, in association with a type of the discharge target. The correction value update unit is configured to update, via the storage control unit, the correction value stored in the storage unit, based on input received by an input receiving unit configured to receive the input from a user. The correction value update unit is configured to perform update with as identical correction value for a plurality of different types of discharge targets.

10 Claims, 9 Drawing Sheets

FIG.7

P1

SHEET DATA SETTING SCREEN

■SHEET NAME: ○○ COMPANY

■PAPER TYPE: PLAIN PAPER ▼

■COLOR TYPE: WHITE ▼

■COATING TYPE: GLOSS PAPER ▼

■CORRECTION VALUE

| SHEET SIZE | IMAGE QUALITY MODE | PRE-COATING | SHEET SURFACE | CORRECTION VALUE | | |
|---|---|---|---|---|---|---|
| SIZE A4 PORTRAIT | HIGH PRODUCTIVITY | APPLIED | FRONT | B | CHANGE ... | B1 |
| | | | BACK | B | CHANGE ... | B1 |
| | | NOT APPLIED | FRONT | F | CHANGE ... | B1 |
| | | | BACK | F | CHANGE ... | B1 |
| | HIGH IMAGE QUALITY | APPLIED | FRONT | B | CHANGE ... | B1 |
| | | | BACK | C | CHANGE ... | B1 |
| | | NOT APPLIED | FRONT | D | CHANGE ... | B1 |
| | | | BACK | D | CHANGE ... | B1 |
| SIZE A4 LANDSCAPE | HIGH PRODUCTIVITY | APPLIED | FRONT | H | CHANGE ... | B1 |

⋮

FIG.8

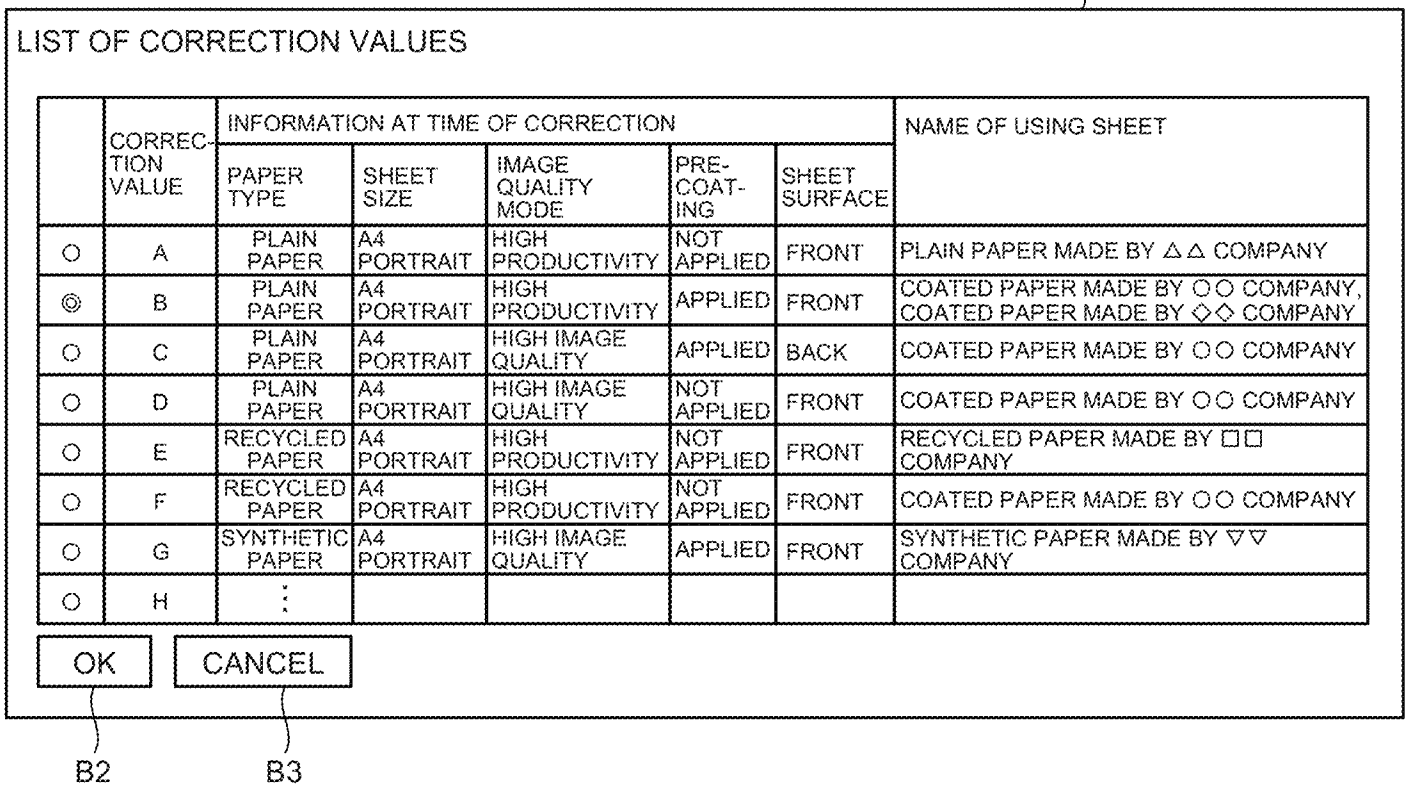

| | CORRECTION VALUE | INFORMATION AT TIME OF CORRECTION | | | | | NAME OF USING SHEET |
|---|---|---|---|---|---|---|---|
| | | PAPER TYPE | SHEET SIZE | IMAGE QUALITY MODE | PRE-COAT-ING | SHEET SURFACE | |
| ○ | A | PLAIN PAPER | A4 PORTRAIT | HIGH PRODUCTIVITY | NOT APPLIED | FRONT | PLAIN PAPER MADE BY △△ COMPANY |
| ◎ | B | PLAIN PAPER | A4 PORTRAIT | HIGH PRODUCTIVITY | APPLIED | FRONT | COATED PAPER MADE BY ○○ COMPANY, COATED PAPER MADE BY ◇◇ COMPANY |
| ○ | C | PLAIN PAPER | A4 PORTRAIT | HIGH IMAGE QUALITY | APPLIED | BACK | COATED PAPER MADE BY ○○ COMPANY |
| ○ | D | PLAIN PAPER | A4 PORTRAIT | HIGH IMAGE QUALITY | NOT APPLIED | FRONT | COATED PAPER MADE BY ○○ COMPANY |
| ○ | E | RECYCLED PAPER | A4 PORTRAIT | HIGH PRODUCTIVITY | NOT APPLIED | FRONT | RECYCLED PAPER MADE BY □□ COMPANY |
| ○ | F | RECYCLED PAPER | A4 PORTRAIT | HIGH PRODUCTIVITY | NOT APPLIED | FRONT | COATED PAPER MADE BY ○○ COMPANY |
| ○ | G | SYNTHETIC PAPER | A4 PORTRAIT | HIGH IMAGE QUALITY | APPLIED | FRONT | SYNTHETIC PAPER MADE BY ▽▽ COMPANY |
| ○ | H | ⋮ | | | | | |

FIG.9

P3

CORRECTION VALUE UPDATE CONFIRMATION SCREEN

CHECK TO APPLY UPDATED CORRECTION VALUE TO SHEET BEING CURRENTLY USED

CORRECTION VALUE NAME: B

[INFORMATION AT TIME OF CORRECTION]
SHEET TYPE: PLAIN PAPER
SHEET SIZE: A4
IMAGE QUALITY MODE: HIGH PRODUCTIVITY
PRE-COATING: APPLIED
SHEET SURFACE: FRONT

[ENABLING OF UPDATE IN USING SHEET]

| | ENABLING OF UPDATE | |
|---|---|---|
| COATED PAPER MADE BY ○○ COMPANY | ☑ | C1 |
| COATED PAPER MADE BY ◇◇ COMPANY | ☐ | C2 |

DISCHARGE CONTROL APPARATUS, LIQUID DISCHARGE APPARATUS, AND COMPUTER-READABLE MEDIUM

CROSS-REFERENCE TO RELATED APPLICATIONS

The present application claims priority under 35 U.S.C. § 119 to Japanese Patent Application No. 2020-142788, filed on Aug. 26, 2020. The contents of which are incorporated herein by reference in their entirety.

BACKGROUND OF THE INVENTION

1. Field of the Invention

The present invention relates to a discharge control apparatus, a liquid discharge apparatus, and a computer-readable medium.

2. Description of the Related Art

Conventionally, in a liquid discharge apparatus of a line head system, a technology for correcting non-discharge at each of detected defective nozzles in order to prevent reduction in image quality due to non-discharge or discharge deviation of liquid has been known.

Japanese Unexamined Patent application Publication. No. 2014-54763 discloses a technology for acquiring read data of a test chart that is recorded on a recording medium on the basis of a non-discharge correction parameter that is a correction value of each of nozzles on an inkjet head, and optimizing the non-discharge correction parameter of each of the nozzles on the basis of a single variable root-finding algorithm using an iterative method from correction intensity of the non-discharge correction parameter of each of the nozzles, where the correction intensity is evaluated based on the acquired read data.

However, there is a problem in that influence of non-discharge of liquid from the nozzles on image quality varies depending on characteristics of each type of discharge target. Specifically, there is a problem in that a correction value that is adjusted based on a predetermined type of discharge target is not an appropriate correction value for a different type of discharge target.

SUMMARY OF THE INVENTION

According to an aspect of the present invention, a discharge control apparatus includes a storage control unit, and a correction value update unit. The storage control unit is configured to store, in a storage unit, a correction value for correcting a value related to discharge performed by a liquid discharge unit configured to discharge liquid to a discharge target, in association with a type of the discharge target. The correction value update unit is configured to update, via the storage control unit, the correction value stored in the storage unit, based on input received by an input receiving unit configured to receive the input from a user. The correction value update unit is configured to perform update with an identical correction value for a plurality of different types of discharge targets.

BRIEF DESCRIPTION OF THE DRAWINGS

FIG. 7 is a diagram illustrating an example of a sheet data setting screen;

FIG. 8 is a diagram illustrating an example of a correction value list screen; and FIG. 9 is a diagram illustrating an example of a correction value update confirmation screen.

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
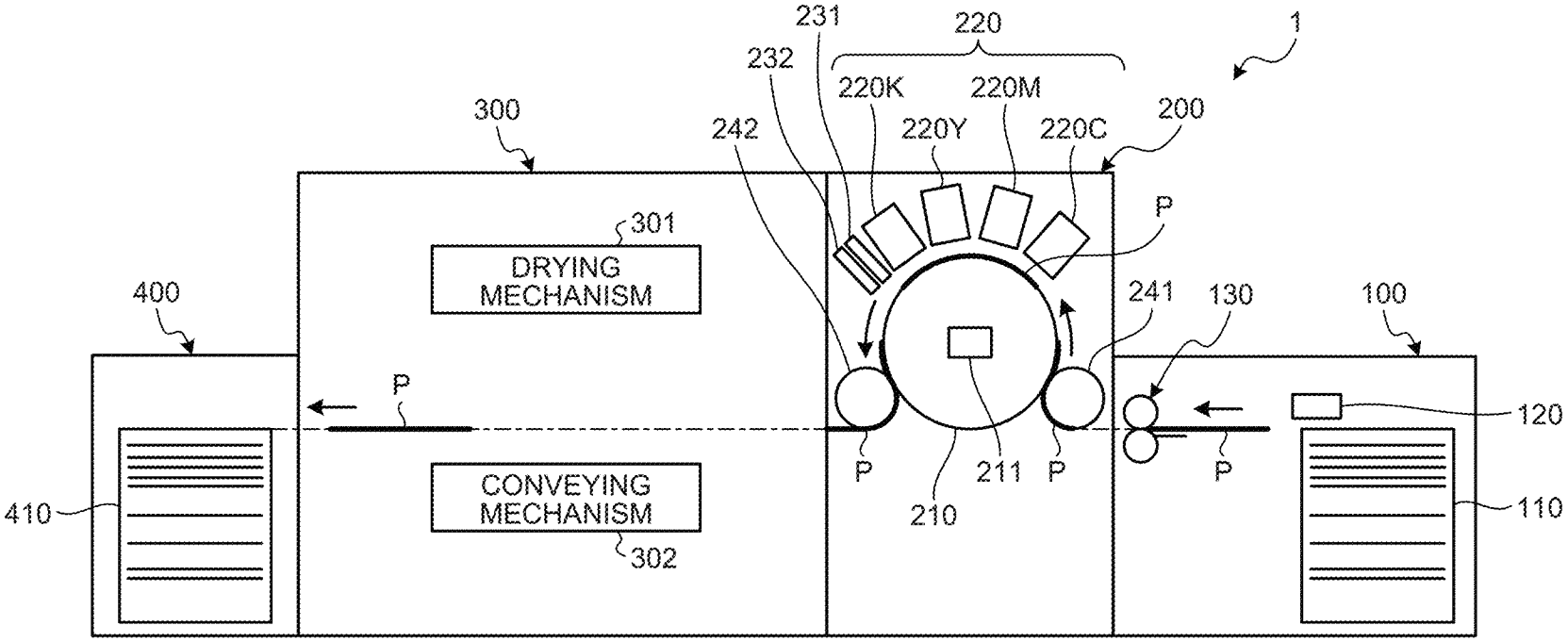
FIG. 1 is a schematic diagram illustrating an overall configuration of an inkjet recording apparatus according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to adopt an appropriate correction value for each type of discharge target.

Embodiments of a discharge control apparatus, a liquid discharge apparatus, and a computer-readable medium will be described in detail below with reference to the accompanying drawings. In the present embodiments, an inkjet recording apparatus of an inkjet type is adopted as the liquid discharge apparatus.

FIG. 1 is a schematic diagram illustrating an overall configuration of an inkjet recording apparatus 1 according to an embodiment. As illustrated in FIG. 1, the inkjet recording apparatus 1 mainly includes a paper feed unit 100, an image forming unit 200, a drying unit 300, and a paper ejection unit 400. The inkjet recording apparatus 1 causes the image forming unit 200 to form, with ink that is liquid for image formation, an image on a sheet P that is a sheet recording medium as a discharge target that is fed from the paper feed unit 100. Further, the inkjet recording apparatus 1 causes the drying unit 300 to dry the ink attached to the sheet F, and thereafter causes the paper ejection unit 400 to eject the sheet P.

The paper feed unit 100 will be described below.

The paper feed unit 100 mainly includes a paper feed tray 110 on which a plurality of sheets P are stacked, a feed device 120 That separates and feeds each of the sheets P from the paper feed tray 110, and a registration roller pair 130 that feeds the sheet P to the image forming unit 200.

As the feed device 120, every kind of feed devices, such as a device using a roller or a ball or a device using air suction, may be used.

The paper feed unit 100 drives the registration roller pair 130 at a predetermined timing after a leading end of the sheet P that is fed from the paper feed tray 110 by the feed device 120 reaches the registration roller pair 130. Accordingly, the sheet P is fed to the image forming unit 200.

Meanwhile, in the present embodiment, the configuration of the paper feed unit 100 is not specifically limited as long as it is possible to feed the sheet P to the image forming unit 200.

The image forming unit 200 will be described below.

The image forming unit 200 mainly includes a receiving drum 241, a sheet bearing drum 210, an ink discharge unit 220 that functions as a liquid discharge unit, and a transfer drum 242. The receiving drum 241 receives the fed sheet P. Inc sheet bearing drum 210 that functions as a conveying unit bears the sheet P conveyed by the receiving drum 241 on an outer periphery thereof, and conveys the sheet P. The ink discharge unit 220 selectively discharges ink that is liquid from a plurality of nozzles to the sheet P that is bore on the sheet bearing drum 210. The transfer drum 242 transfers the sheet P conveyed by the sheet bearing drum 210 to the drying unit 300.

A leading end of the sheet P conveyed from the paper feed unit 100 to the image forming unit 200 is gripped by a sheet gripper that is arranged on a surface of the receiving drum 241, and the sheet P is conveyed along with movement of the front surface of the receiving drum 241. The sheet P conveyed by the receiving drum 241 is transferred to the sheet bearing drum 210 at a position facing the sheet bearing drum 210.

A sheet gripper is also arranged on a surface of the sheet bearing drum 210, and the sheet gripper grips the leading end of the sheet P. Further, plurality of suction holes are formed in a distributed manner on the surface of the sheet bearing drum 210, and a suction device 211 generates, at each of the suction holes, suction airflow toward an inside of the sheet bearing drum 210.

The leading end of the sheet P transferred from the receiving drum 241 to the sheet bearing drum 210 is gripped by the sheet gripper, and the sheet P sticks to the surface of the sheet bearing drum 210 with the aid of the suction airflow and is conveyed along with surface movement of the sheet bearing drum 210.

The ink discharge unit 220 of the present embodiment is a line head that selectively discharges ink of four colors of cyan (C), magenta (M), yellow (Y), and black (K) from a plurality of nozzles and forms an image, and includes liquid discharge heads 220C, 220M, 220Y, and 220K for the ink of the respective colors.

Meanwhile, the configurations of the liquid discharge heads 220C, 220M, 220Y, and 220K are not specifically limited as long as it is possible to discharge the liquid, and it is possible to adopt every kind of configurations. It may be possible to arrange a liquid discharge head that discharges special ink, such as white ink, gold ink, or silver ink, or a liquid discharge head that discharges liquid, such as surface coating liquid, that is not used for an image, as needed basis.

Discharge operation of each of the liquid discharge heads 220C, 220M, 220Y, and 220K of the ink discharge unit 220 is controlled by a driving signal corresponding to image information. When the sheet P bore on the sheet bearing drum 210 passes through a region facing the ink discharge unit 220, ink of the plurality of colors are selectively discharged from a plurality of nozzles of the liquid discharge heads 220C, 220M, 220Y, and 220K, and an image corresponding to the image information is formed.

Meanwhile, in the present embodiment, the configuration of the image forming unit 200 is not specifically limited as long as it is possible to attach the liquid to the sheet P to form an image.

In addition, as illustrated in FIG. 1, the image forming unit 200 includes two scanners 231 and 232 that are line scanners on a downstream side relative to the ink discharge unit 220 in a conveying direction of the sheet P. The two scanners 231 and 232 read a test chart that is used to detect a defective nozzle. Meanwhile, resolution of the two scanners 231 and 232 is lower than printing resolution in the image forming unit 200.

The image forming unit 200 prints, by the ink discharge unit 220, the test chart in a state in which the leading end of the sheet P is gripped by the sheet gripper and the sheet P is conveyed by being sucked and adsorbed onto the surface of the sheet bearing drum 210, and causes the two scanners 231 and 232 to read the test chart immediately after the test chart is printed.

Figure 2:
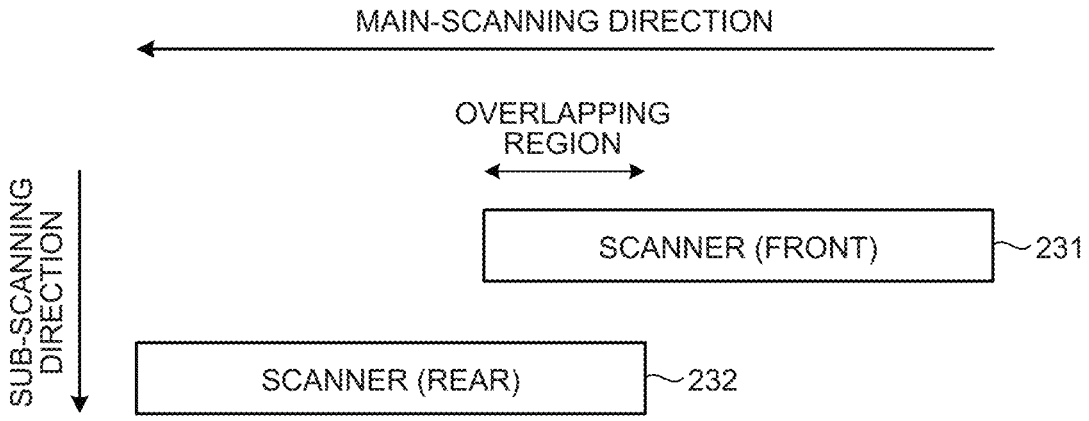
FIG. 2 is a diagram illustrating an arrangement example of two scanners.

FIG. 2 is a diagram illustrating an arrangement example or the two scanners 231 and 232. As illustrated in FIG. 2, the two scanners, that is, the scanner (front) 231 and the scanner (rear) 232, are arranged in a zig-zag manner to read the entire surface of the sheet P. More specifically, the two scanners 231 and 232 have regions (overlap regions) in which reading ranges overlap (redundant) with each other in a main-scanning direction. Further, the two scanners 231 and 232 are arranged so as to be deviate from each other in a sub-scanning direction.

Meanwhile, the two scanners 231 and 232 are arranged in the present embodiment, but embodiments are not limited to this example, and as long as it is possible to ensure a reading range in the main-scanning direction, it may be possible to arrange a single scanner or a combination of three or more scanners.

The drying unit 300 will be described below.

The drying unit 300 mainly includes a drying mechanism 301 that dries the ink that is attached to the sheet P by the image forming unit 200, and a conveying mechanism 302 that conveys the sheet P that is conveyed from the image forming unit 200.

The drying unit 300 receives, by the conveying mechanism 302, the sheet P that is conveyed from the image forming unit 200, thereafter conveys the sheet P such that the sheet P passes through the drying mechanism 301, and transfers the sheet P to the paper election unit 400. The drying unit 300 performs a drying process on the ink on the sheet P when the sheet P passes through the drying mechanism 301. Accordingly, liquid, such as moisture, in the ink evaporates, so that the ink is fixed to the sheet P and the sheet P is prevented from being bent.

The paper ejection unit 400 will be described below.

The paper ejection unit 400 mainly includes a paper ejection tray 410 on which the plurality of sheets of sheet P are stacked. The paper ejection unit 400 sequentially stacks the plurality of sheets P that are conveyed from the drying unit 300, one on top of the other on the paper ejection tray 410.

Meanwhile, in the present embodiment, the configuration of the paper ejection unit 400 is not specifically limited as long as it is possible to eject the sheet P.

Other functional units will be described below.

While the inkjet recording apparatus 1 of the present embodiment includes the paper feed unit 100, the image forming unit 200, the drying unit 300, and the paper ejection unit 400, it may be possible to appropriately add other functional units. For example, it is possible to add a pre-processing unit, which performs pre-processing for image formation, between the paper feed unit 100 and the image forming unit 200, or may include a post-processing unit, which performs post-processing for image formation, between the drying unit 300 and the paper ejection unit 400.

The pre-processing unit may be, for example, a unit that performs a treatment liquid application process of applying treatment liquid to the sheet P in order to prevent bleeding due to reaction with the ink or the like, but details of the pre-processing are not specifically limited. Further, the post-processing unit may include, for example, a unit that performs a sheet inverting conveyance process of inverting the sheet P on which an image is formed by the image forming unit 200 and feeding the sheet P to the image forming unit 200 again to form images on both sides of the sheet P, a unit that performs a process of binding a plurality of sheets P on which images are formed, a correction mechanism that corrects deformation of the sheet P, a cooling mechanism that cools the sheet P, or the like, but details of the post-processing are not specifically limited.

A control configuration of the inkjet recording apparatus 1 will be described below.

Figure 3:
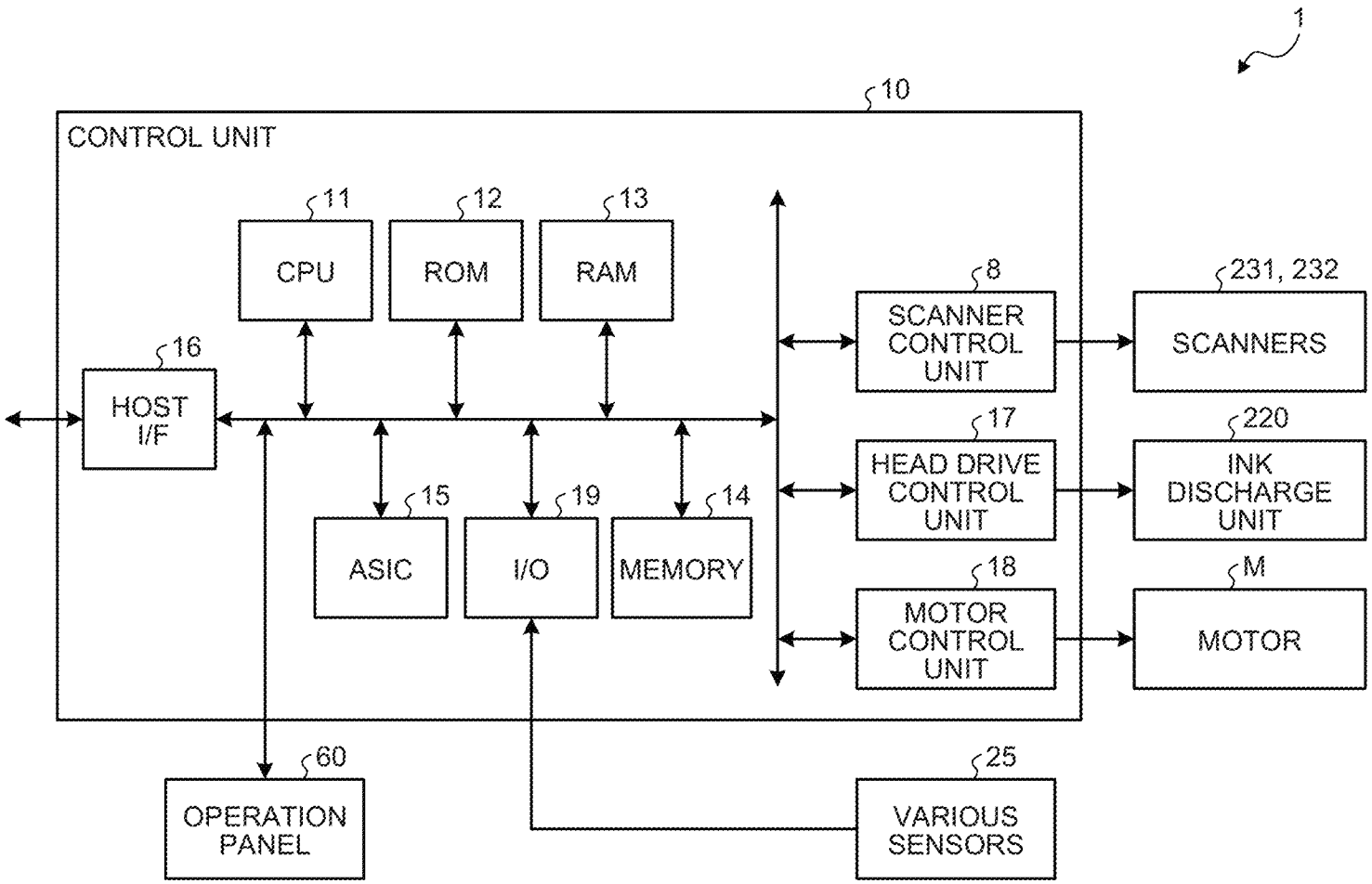
FIG. 3 is a block diagram illustrating a control configuration of the inkjet recording apparatus.

FIG. 3 is a block diagram illustrating the control configuration of the inkjet recording apparatus 1. As illustrated in FIG. 3, the inkjet recording apparatus 1 includes a control unit 10 that controls the entire apparatus. The control unit 10 functions as the discharge control apparatus, and includes a central processing unit. (CPU) 11 that serves as a control body, a read only memory (ROM) 12, a random access memory (RAM) 13, a memory 14, and an application specific integrated circuit (ASIC) 15. The ROM 12 stores therein a computer program to be executed by the CPU 11 and other kinds of fixed data. The RAM 13 temporarily stores therein image data or the like. The memory 14 functions as a storage unit, and is a nonvolatile memory capable of performing rewrite to maintain data while power of the inkjet recording apparatus 1 is turned off. The ASIC 15 performs image processing for performing various kinds of signal processing, rearrangement, or the like on the image data, and input-output signal processing for entirely controlling other apparatuses.

Furthermore, as illustrated in FIG. 3, the control unit 10 includes a host interface (I/F) 16, a head drive control unit 17, a motor control unit 18, an I/O 19, and a scanner control unit 8.

The host. I/F 16 transmits and receives image data (print data) and a control signal to and from a host side via a cable or a network. Examples of the host connected to the inkjet recording apparatus 1 include an information processing apparatus, such as a personal computer, an image reading apparatus, such as an image scanner, and an image capturing apparatus, such as a digital camera.

The I/O 19 connects various sensors 25, such as a humidity sensor, a temperature sensor, and other sensors. The I/O 19 inputs detection signals from the various sensors 25.

The head drive control unit 17 drives and controls the ink discharge unit 220, and includes a data transfer means. More specifically, the head drive control unit 17 transfers image data as serial data. Further, the head drive control unit 17 generates a transfer clock and a latch signal that are needed to transfer image data and confirm the transfer, and a drive waveform that is used when the ink discharge unit 220 discharges liquid droplets. Furthermore, the head drive control unit 17 inputs the generated drive waveform or the like to a driving circuit incorporated in the ink discharge unit 220.

The motor control unit 18 drives a motor M that rotates the receiving drum 241, the sheet bearing drum 210, and the transfer drum 242.

The scanner control unit 8 controls the two scanners 231 and 232.

In addition, the control unit 10 is connected to an operation panel 60 for inputting and displaying information that is needed for the inkjet recording apparatus 1. The operation panel 60 functions as an input receiving unit.

The control unit 10 integrally controls each of the units by causing the CPU 11 to read a computer program from the ROM 12 (or the memory 14), load the computer program onto the RAM 13, and execute the computer program. More specifically, the CPU 11 reads control details that are set for each of printing modes from the ROM 12 (or the memory 14), on the basis of a printing mode that is set by the operation panel 60. Further, the CPU 11 controls each of the units on the basis of the control details read from the RUM 12 (or the memory 14), thereby performing control as will be described later.

Meanwhile, the computer program executed by the inkjet recording apparatus 1 of the present embodiment is provided by being recorded in a computer readable recording medium, such as a compact disk (CD)-ROM, a flexible disk (FD), a CD-recordable (CD-R), or a digital versatile disk (DVD), in a computer-installable or computer-executable file format.

Further, the computer program executed by the inkjet recording apparatus 1 of the present embodiment may be stored in a computer that is connected to a network, such as the Internet, and may be provided by being downloaded through the network. Furthermore, the computer program executed by the inkjet recording apparatus 1 of the present embodiment may be provided or distributed via a network, such as the Internet.

Moreover, the computer program executed by the inkjet recording apparatus 1 of the present embodiment may be provided by being incorporated in a ROM or the like in advance.

A correction process that is performed on a defective nozzle by the control unit 10 of the inkjet recording apparatus 1 in accordance with a computer program will be briefly described below. The correction process on the defective nozzle is a technology, that is described in, for example, Japanese Unexamined Patent Application Publication No. 2014-54763.

The control unit 10 of the inkjet recording apparatus 1 generates test chart data on the basis of a correction value (non-discharge correction parameter) of each of nozzles that are arranged on the liquid discharge heads 220C, 220M, 220Y, and 220K. The control unit 10 causes the plurality of nozzles to discharge ink on the basis of the test chart data while relatively moving the liquid discharge heads 220C, 220M, 220Y, 220K and the sheet P, and acquires, by the scanners 231 and 232, read data of a test chart that is recorded on the sheet P.

Subsequently, the control unit 10 evaluates correction intensity of the correction value (non-discharge correction parameter) of each of the nozzles arranged on the liquid discharge heads 220C, 220M, 220Y, and 220K on the basis of the acquired read data. Further, the control unit 10 repeats operation of updating the correction value (non-discharge correction parameters) of each of the nozzles on the basis of a single variable root-finding algorithm using an iterative method from the evaluated correction intensity, and optimizes the correction value (non-discharge correction parameters) of each of the nozzles.

While details will be described later, the correction value optimized through the process as described above is stored in the memory 14 in association with a type of a discharge target.

Functions related to a correction value update process that is performed by the control unit 10 of the inkjet recording apparatus 1 in accordance with a computer program will be described below.

Figure 4:
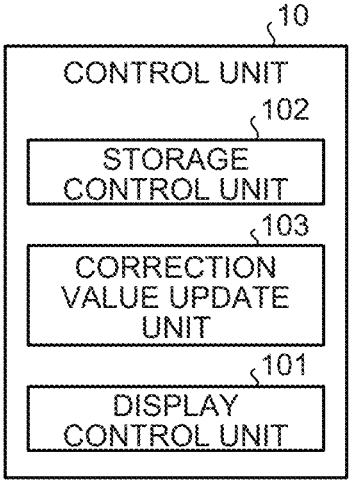
FIG. 4 is a functional block diagram illustrating functions related to a correction value update process.

FIG. 4 is a functional block diagram illustrating the functions related to the correction value update process. As illustrated in FIG. 4, the control unit 10 functions as a display control unit 101, a storage control unit 102, and a correction value update unit 103.

The display control unit 101 displays, on the operation panel 60, a sheet data setting screen P1 (see FIG. 7) that is a screen for registering a correction value related to the sheet P as a discharge target. The operation panel 60 notifies the display control unit 101 of an event based on operation that is performed by a user via the operation panel 60.

The display control unit 101 notifies the correction value update unit 103 of information that is needed to update the correction value, in accordance with the event for which notice has been given by the operation panel 60.

Furthermore, the display control unit. 101 receives a notice of a result from the correction value update unit 103, and displays an update result on the operation panel 60.

The storage control unit 102 controls storage of the sheet data and the correction value data in the memory 14.

Figure 5:
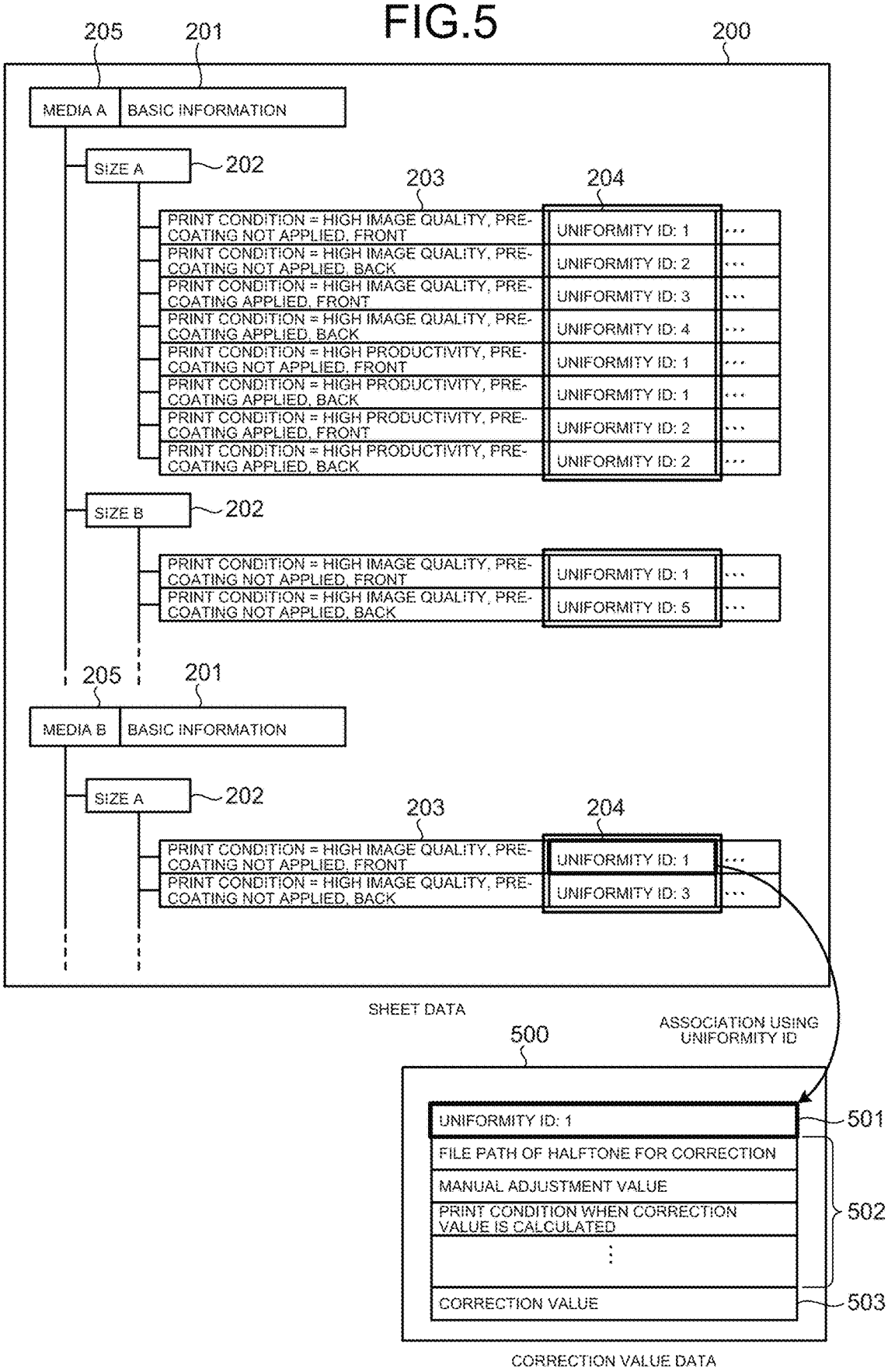
FIG. 5 is a diagram illustrating examples of sheet data and correction value data.

FIG. 5 is a diagram illustrating examples of sheet data 200 and correction value data 500. As illustrated in FIG. 5, a media ID 205 for identifying a type of the sheet P is assigned to the sheet data 200. The storage control unit 102 stores, as basic information 201 of the sheet data 200, a paper type, a color, a coating type, and the like of each sheet P and information, such as a print condition (a print mode, dot gain, or the like), that is not dependent on a sheet size, in the memory 14 in association with the media ID 205.

Further, the storage control unit 102 stores, as the sheet data 200, a uniformity ID 204 that is information on a correction value or the like that is dependent on a sheet size 202, in the memory 14 in conjunction with each of print conditions 203.

In the correction value data 500, a uniformity ID 501 is assigned in association with a correction value 503. The storage control unit 102 stores, as the correction value data 500, information 502 related to information on halftone to be used when correction is applied, a manual adjustment value, and a print condition when generating a correction value, in the memory 14 in association with the uniformity ID 501.

Referring back to FIG. 4, the correction value update unit 103 receives the media ID 205 associated with the sheet data 200 that is designated in registering a correction value, the correction value designated for the sheet data 200, and a print condition for which the designated correction value is to be applied, from the display control unit 101 via the operation panel 60.

Further, the correction value update unit 103 acquires the sheet data 200 and the correction value data 500 from the memory 14 via the storage control unit 102 on the basis of the received media ID and the received uniformity ID, and determines whether the print condition for the designated correction value is applicable as the print condition 203 for the designated sheet data 200.

If it is confirmed that the print condition for the designated correction value is applicable as the print condition 203 for the designated sheet data 200, the correction value update unit 103 updates the uniformity ID 501 of the correction value data 500 associated with the sheet data 200.

A flow of the correction value update process will be described below.

Figure 6:
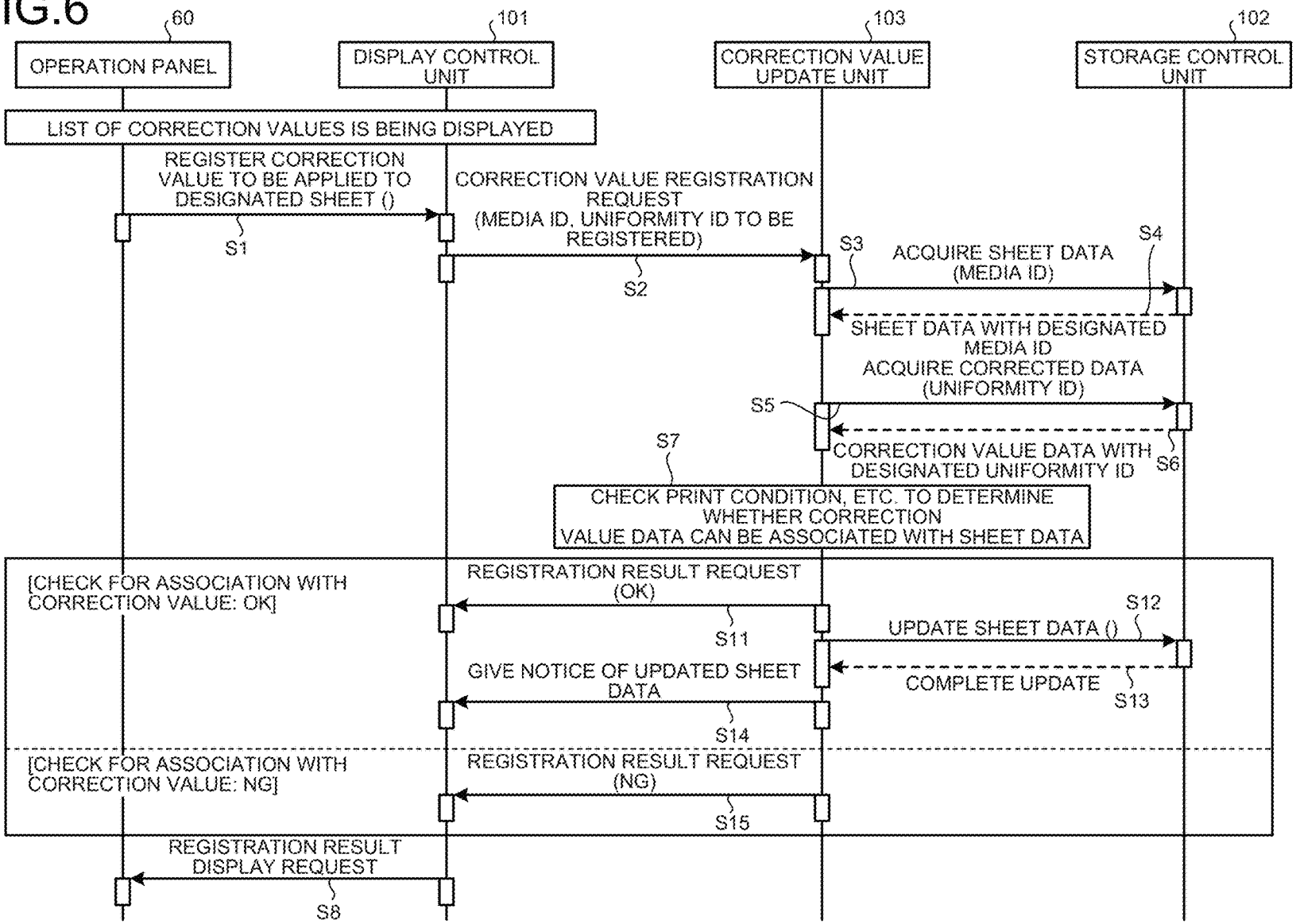
FIG. 6 is a sequence diagram illustrating the correction value update process.

FIG. 6 is a sequence diagram illustrating the correction value update process. As illustrated in FIG. 6, it is presumed that the display control unit 101 is displaying, on the operation panel 60, the sheet data setting screen P1 that is a screen for registering a correction value related to the sheet P as a discharge target.

FIG. 7 is a diagram illustrating an example of the sheet data setting screen P1. As illustrated in FIG. 7, the sheet data setting screen P1 is a screen for performing setting related to a paper type and a correction value. More specifically, the sheet data setting screen P1 receives setting of a sheet name, a paper type, a color type, a coating type, a correction value, and the like in relation to the sheet P as the discharge target. The sheet name is a name, such as "coated paper made by oo company", for identifying the sheet P. The paper type indicates a type, such as plain paper, recycled paper, or synthetic paper, of the sheet P. The color type indicates a color, such as white or black, of the sheet. The coating type indicates a type, such as gloss paper, of coating on the sheet P.

The correction value is set in association with a sheet size, an image quality mode, information on pre-coating, and information on a sheet surface of the sheet P. The sheet size indicates a size and orientation of the sheet, such as A4 portrait or A4 landscape. The image quality mode indicates a high productivity mode in which priority is given to speed, a high image quality mode in which priority is given to quality, or the like. The information on pre-coating indicates whether pre-coating is performed on the sheet P. The information on the sheet surface indicates a front surface of the sheet or a back surface of the sheet.

As illustrated in FIG. 7, correction values are displayed on the sheet data setting screen P1 together with correction value change buttons B1.

If a user operates a desired one of the correction value change buttons B1 in the sheet data setting screen P1 displayed on the operation panel 60 in the state as described above, the operation panel 60 gives, to the display control unit 101, a notice indicating that the correction value to be applied to the designated sheet is registered (Step S1).

The display control unit 101 notifies the correction value update unit 103 of information (the media ID and the uniformity ID to be registered) that is needed to update the correction value, as a correction value registration request (Step S2).

The correction value update unit 103 notifies the storage control unit 102 of the media ID that is designated to acquire the sheet data (Step S3).

The storage control unit 102 acquires, from the memory 14, the sheet data based on the designated media ID for which notice has been given by the correction value update unit 103, and notifies the correction value update unit 103 of the sheet data (Step S4).

The correction value update unit 103 notifies the storage control unit 102 of the uniformity ID that is designated to acquire the correction value data (Step S5).

The storage control unit 102 acquires, from the memory 14, the correction value data based on the designated uniformity ID for which notice has been given by the correction value update unit 103, and notifies the correction value update unit 103 of the correction value data (Step S6).

The correction value update unit 103 displays a correction value list screen P2 (see FIG. 8) on the basis of the sheet data and the correction value data (Step S7).

FIG. 8 is a diagram illustrating an example of the correction value list screen P2. As illustrated in FIG. 8, the correction value list screen P2 displays a print condition when a correction value is generated and a name of a sheet for which the correction value is set to be used. Specifically, the correction value list screen P2 displays a list of correction values that can be set for print conditions or the like that are to be set. In the correction value list screen P2, information at the time of correction and a name of paper being used are displayed for each of the correction values. The information at the time of correction includes the paper type, the sheet size, the image quality mode, the information on pre-coating, and the information on the sheet surface. Further, in the correction value list screen P2, a circle indicating that the correction value is settable is assigned to each of the correction values. Meanwhile, a double circle indicates a selected correction value.

The user checks the print condition as to whether it is possible to associate the correction value of the sheet P with the sheet data, on the basis of the print condition (information at the time of correction or the like) that is displayed on the correction value list screen P2. By determining a correction value that the user wants to apply to the sheet P by selecting the correction value that the user wants to apply to the sheet P from the correction values displayed on the correction value list screen P2 and operating an OK button B2 in the correction value list screen P2, the user is able to apply an existing correction value to the sheet P. Meanwhile, if the user operates a cancel button B3 in the correction value list screen P2, the correction value update unit 103 returns the screen to the sheet data setting screen P1.

Specifically, the correction value list screen P2 is used when different kinds or sheet with similar density unevenness characteristics are searched for on the basis of the print conditions (information at the time of correction or the like) and an identical correction value is to be used between the different kinds of sheets with similar density unevenness characteristics. In this case, a single correction value is referred to by a plurality of kinds of sheets. If the correction value as described above is updated or adjusted, the updated or adjusted correction value is applied to all kinds of sheets that refer to the correction value.

Meanwhile, it may be possible to prevent registration of a correction value that is generated for a sheet for which a different print quality mode or different dot gain (halftone) is set. With this configuration, even if the user does not have knowledge about a correctable condition, it is possible to set an appropriate correction value.

Meanwhile, in the correction value list screen P2, it may be possible to display an value (not corrected) and allow selection of the initial value (not corrected).

If the correction value is selected and the OK button B2 is operated, the correction value update unit 103 displays a correction value update confirmation screen P3 (see FIG. 9).

FIG. 9 is a diagram illustrating an example of the correction value update confirmation screen P3. As illustrated in FIG. 9, the correction value update confirmation screen P3 allows the user to select whether to perform update when a certain correction value is to be updated and the certain correction value is used in different kinds of sheets. The correction value update confirmation screen P3 includes a checkbox that asks whether to enable update for the using sheet, in addition to the information (the paper type, the sheet size, the image quality mode, the information on pre-coating, and the information on the sheet surface) that is obtained in relation to the correction value at the time of correction. If the selected correction value is used by two kinds of sheets, the correction value update confirmation screen P3 includes checkboxes C1 and C2 for the two respective kinds of sheets. The checkboxes are to cause the user to declare if association of the correction value is OK or not. In the example illustrated in FIG. 9, the checkbox C1 for one kind of sheet is checked, but the checkbox C2 for the other kind of sheet is not checked. Accordingly, the correction value is not automatically updated, but can be updated by selection by the user, so that it is possible to prevent unintended update.

The correction value update unit 103 confirms the checkbox in the correction value update confirmation screen P3. If the checkbox in the correction value update confirmation screen P3 is checked, the correction value update unit 103 determines that association with the correction value is permitted, and notifies the display control unit 101 of a registration request result (OK) (Step S11).

Thereafter, the correction value update unit 103 notifies the storage control unit 102 of update of the sheet data in the memory 14 (Step S12).

Upon completing the update of the sheet data for which notice has been given by the correction value update unit 103, the storage control unit 102 notifies the correction value update unit 103 of completion of the update (Step S13).

Then, upon receiving the notice of completion of the update of the sheet data, the correction value update unit 103 notifies the display control unit 101 of the updated sheet data (Step S14).

In contrast, if the checkbox in the correction value update confirmation screen P3 is not checked, the correction value update unit 103 determines that association with the correction value is not permitted, and notifies the display control unit 101 of a registration request result (NG) (Step S15). If the update is not performed as described above, the correction value update unit 103 copies the correction value that is present before the update, and assigns a different correction value ID.

Finally, the display control unit 101 notifies the operation panel 60 of a registration result display request, and displays a registration result (Step S8).

As described above, according to the present embodiment, when the user generates or edits the set sheet, it is possible to select and register an arbitrary correction value from a list of correction values that are already generated. In other words, according to the present embodiment, it is possible to register a correction value for each type of discharge target and register an identical correction value for a plurality of different types of discharger targets, so that it is possible to apply an appropriate correction value for each type of discharge target.

Furthermore, according to the present embodiment, by associating an existing uniformity ID with a new sheet, it is not necessary to repeat correction if an identical correction value is applicable to the sheet.

Moreover, according to the present embodiment, when an existing uniformity ID is associated with a new sheet, it is possible to perform selection based on a document, rather than the correction value. By selecting a sheet that is similar to a sheet to be newly used, it is possible to easily select a more appropriate correction parameter.

Meanwhile, in the present embodiment, an application example in which the inkjet recording apparatus 1 is adopted as the liquid discharge apparatus has been described, but the "liquid discharge apparatus" is not limited to an apparatus that includes a liquid discharge head for discharging liquid to a drying target surface of a recording medium being a discharge target and that visualizes a meaningful image, such as a character or a graphic, by using the discharged liquid, but an apparatus that generates a pattern that does not have any meaning, for example.

Furthermore, a material of the recording medium is not specifically limited, but may be any material, such as paper, thread, fiber, cloth, leather, metal, plastic, glass, wood, or ceramics, to which liquid is attachable at least temporarily, and may be a material used for, for example, a film product, a fabric product for clothing or the like, a building product, such as wallpaper or a floor material, a leather product, or the like.

Moreover, the "liquid discharge apparatus" may include a means for feeding, conveying, or ejecting an object to which liquid is attachable, a pre-processing apparatus, a post-processing apparatus, or the like.

Furthermore, the "liquid" is not specifically limited as long as the liquid has certain viscosity and surface tension that allows the liquid to be discharged from the head; however, it is preferable that the liquid has viscosity of 30 mPa/s or smaller by being heated or cooled under normal temperature and normal pressure. More specifically, the liquid is a solution, a suspension, an emulsion, or the like that includes a solvent such as water or an organic solvent, a coloring material such as dye or pigment, a functionalization material such as polymerizable compound, resin, or surfactant, a biocompatible material such as DNA, amino acid, protein, or calcium, or an edible material such as a natural pigment, and, the above-described liquid may be used as, for example, ink for inkjet, surface treatment liquid, or the like.

Moreover, the "liquid discharge apparatus" is an apparatus in which the liquid discharge head and the recording medium are moved relative to each other, but is not limited thereto. As a specific example, the liquid discharge apparatus includes a serial-type apparatus that moves the liquid discharge head, a linear-type apparatus that does not move the liquid discharge head, or the like.

Furthermore, the "liquid discharge head" is a functional component that discharges or ejects liquid from a discharge hole (nozzle). As an energy generation source for discharging the liquid, an ejection energy generation means, such as a piezoelectric actuator (a laminated piezoelectric element and a thin film piezoelectric element), a thermal actuator using an electrical-to-thermal energy conversion element, such as a heating resistive element, or an electrostatic actuator including a diaphragm and opposing electrodes may be used, but the ejection energy generation means to be used is not specifically limited.

Meanwhile, in the embodiment as described above, the example has been described in which the liquid discharge apparatus of the present invention is applied to the inkjet recording apparatus, but embodiments are not limited to this example, and the present invention may be applied to any of a multifunction peripheral (MFP) that has at least two of a copy function, a printer function, a scanner function, and a facsimile function, and an information processing apparatus, such as a copier, a printer, a scanner, or a facsimile machine.

According to an embodiment, it is possible to register a correction value for each type of discharge target and register an identical correction value for a plurality of different types of discharge targets, so that it is possible to apply an appropriate correction value for each type of discharge target.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (RPM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A discharge control apparatus comprising:

a storage control unit configured to store, in a storage unit, a correction value for correcting a value related to discharge intensity performed by a liquid discharge unit configured to discharge liquid to a discharge target, in association with a type of the discharge target; and a correction value update unit configured to update, via the storage control unit, the correction value stored in the storage unit, based on input received by an input receiving unit configured to receive the input from a user, wherein the correction value update unit is configured to perform the update with an identical correction value for a plurality of different types of discharge targets.

2. The discharge control apparatus according to claim 1, wherein the correction value update unit is configured to adopt an updated correction value of a first correction value being a correction value corresponding to a certain type of discharge target, for a different type of discharge target in response to the input receiving unit receiving input for updating the first correction value, the different type being associated with the certain type of discharge target.

3. The discharge control apparatus according to claim 1, wherein the correction value update unit is configured to display, for a new type of discharge target with which the correction value is not associated, correction values stored in the storage unit in associated with a type of discharge target, to allow selection, and associate, with the new type, a correction value selected from the displayed correction values, for update.

4. The discharge control apparatus according to claim 3, wherein the correction value update unit is configured to exclude a correction value generated for a type of discharge target for which one of a different printing quality mode and different dot gain is set, from the correction values to be displayed to allow selection.

5. The discharge control apparatus according to claim 1, wherein the correction value update unit is configured to display, for a new type of discharge target with which the correction value is not associated, types of discharge targets stored in the storage unit in association with a correction value, to allow selection, and associate, with the new type, a correction value associated with a type of discharge, the type being selected from the displayed types of discharge targets.

6. The discharge control apparatus according to claim 1, wherein the correction value update unit is configured to, in response to updating a correction value of a certain type of discharge target among a plurality of types of discharge targets associated with an identical correction value, perform display to allow selection about whether to store the correction value in the storage unit as a correction value different from the correction value associated with the other types of discharge targets, and update the correction value in accordance with the selection.

7. The discharge control apparatus according to claim 1, wherein the correction value is associated with an image quality mode and recording medium property including a precoating condition and surface orientation.

8. A liquid discharge apparatus comprising:

a liquid discharge unit configured to discharge liquid to a discharge target; and the discharge control apparatus according to claim 1.

9. The liquid discharge apparatus according to claim 8, further comprising an input receiving unit configured to receive input from a user.

10. A non-transitory computer-readable medium including programmed instructions that cause a computer to function as:

a storage control unit configured to store, in a storage unit, a correction value for correcting a value related to discharge intensity performed by a liquid discharge unit configured to discharge liquid to a discharge target, in association with a type of the discharge target; and a correction value update unit configured to update, via the storage control unit, the correction value stored in the storage unit, based on input received by an input receiving unit configured to receive the input from a user, wherein the correction value update unit is configured to perform the update with an identical correction value for a plurality of different types of discharge targets.

* * * * *